United States Patent [19]

Rae

[11] 4,090,165

[45] * May 16, 1978

[54] THERMOSTAT RANGE LIMITER

[76] Inventor: James T. Rae, 4810 Eastern Ave., Suitland, Md. 20023

[ * ] Notice: The portion of the term of this patent subsequent to Dec. 21, 1993, has been disclaimed.

[21] Appl. No.: 727,398

[22] Filed: Sep. 29, 1976

[51] Int. Cl.[2] ..... H01H 37/12

[52] U.S. Cl. ..... 337/360; 337/323; 337/392

[58] Field of Search ..... 337/360, 380, 84, 323, 337/392, 303; 236/94; 74/526; 200/333; 116/133

[56] References Cited

U.S. PATENT DOCUMENTS 3,999,158 12/1976 Rae ..... 335/360

*Primary Examiner*—Harold Broome

[57] ABSTRACT

A device is disclosed which is easily installed in a standard thermostat mechanism to limit the range of temperature to which the thermostat may be adjusted. The device is a generally flat template which is internally installed in the thermostat and physically limits the amount of movement available to the temperature setting member of the thermostat. The thermostat range limiter is easily removed by removing the thermostat cover to facilitate using another limiter having a different range. However, its internal location thwarts overcoming the limited range by the average user of the thermostat.

7 Claims, 4 Drawing Figures

FIG.1
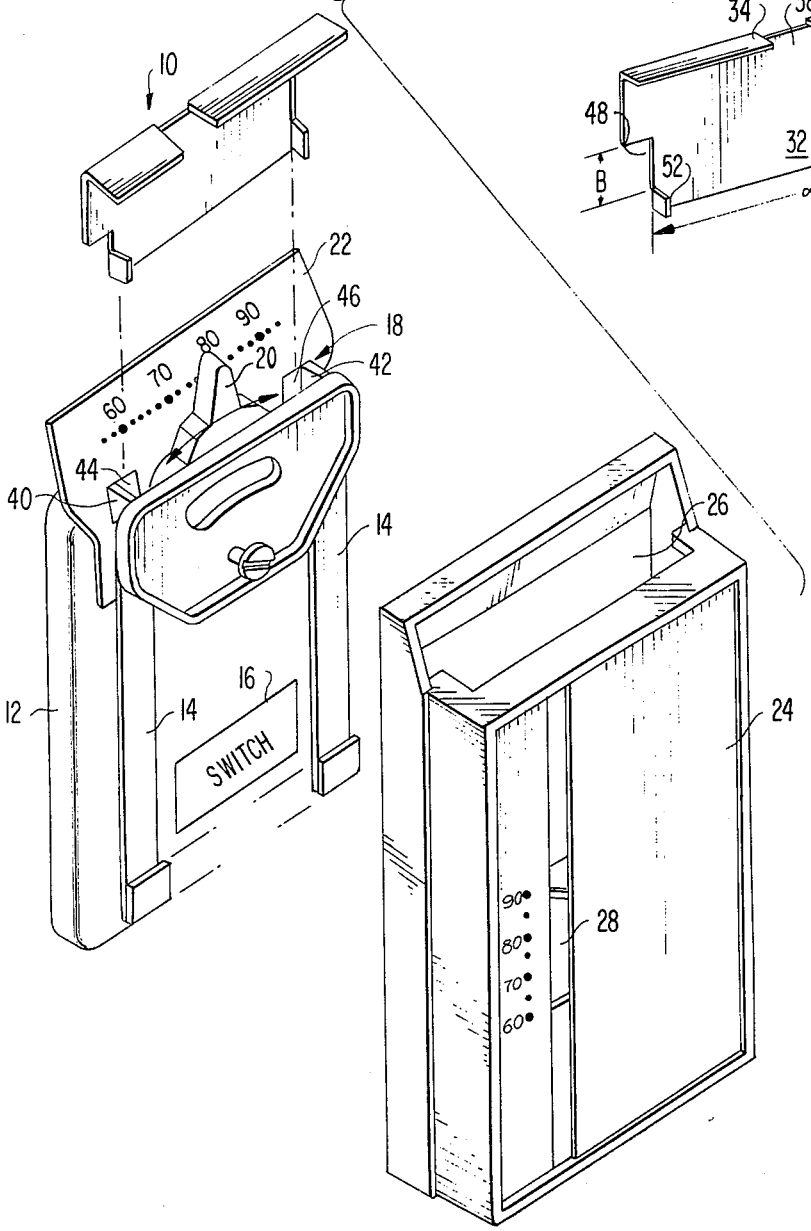
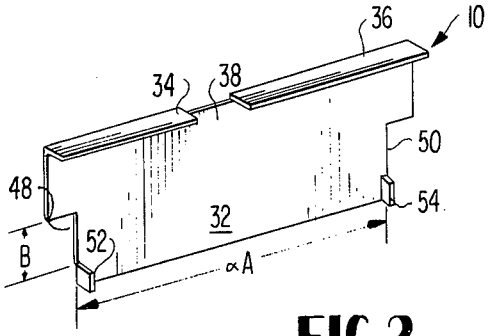
FIG.2
FIG.4
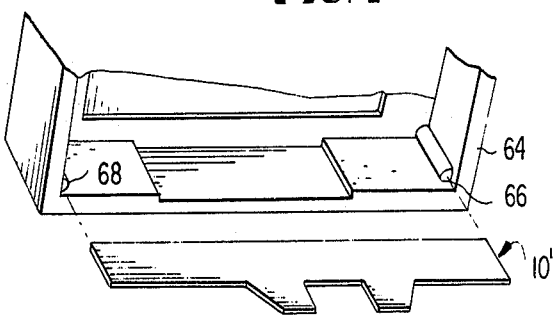
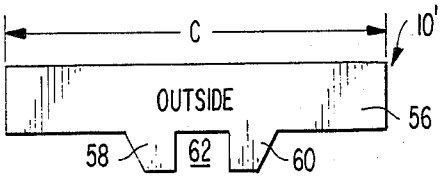
FIG.3

THERMOSTAT RANGE LIMITER

BACKGROUND OF THIS INVENTION

1. Field of this Invention

This invention relates to a range limiter for thermostats, especially thermostats for room-temperature control.

2. Prior Art

In the normal operation of a thermostat, the operating set-point is manually established by adjusting a control member to a desired temperature. The heating apparatus of the room will deliver heat when the temperature drops below the set temperature and the heat will be cut off when the temperature reaches or exceeds the set temperature of the thermostat. The occupant of the room adjusts the control member to establish different set-points. Poorly informed people are tempted to adjust the thermostat incorrectly. Thus, if the room temperature is below the desired temperature, an occupant may adjust the member to a grossly excessive temperature setting, hoping that the room temperature will rise faster. The room temperature rises to the desired temperature and continues rising until the temperature is well above the desired level. Then the occupant (if present) must adjust the thermostat to a lower setting. Once the room temperature is higher than desired, the temptation exists for the occupant to adjust the thermostat well below the desired temperature with the thought that such adjustment will cause the temperature to drop faster. Under such a low thermostat setting, the heater does not turn on until the room temperature drops to an excessively low level. Once again the occupant is unhappily exposed to an uncomfortable temperature.

In an effort to contend with this problem, thermostats often have range-limiting devices. Either a high-limit stop or a low-limit stop has been provided, and in some instances both high and low stops or range limiters have been provided. The arrangements are usually complicated and add significant cost. When a range limiter is provided, the adjustment is restricted to a modest latitude so that, even where an inexpert user is involved, the extent of misadjustment is limited. Accordingly, the consequences of improper adjustment, as set forth above, are minimized. Range limiters are particularly valuable (for example) in motels and other places of public accommodation, because it is not practical to indoctrinate each new guest into the proper use of his room thermostat.

Prior art range limiters are divided into two classes. One class involves a range limiter mounted externally of the thermostat structure. This allows the occupant or guest to readily notice the range limiter and to manipulate or remove it, thereby defeating its purpose. The second class involves a range limiter mounted internally within the thermostat structure. This class of range limiters is permanently or semi-permanently mounted, so that they cannot be replaced with a limiter having a different range. This class also does not involve adjustable means for easily adjusting or changing the range. Further, this class of range limiters often involves a physical deforming or removal of part of the range limiter that makes range changing difficult or impossible using the same permanently (or semi-permanently) mounted range limiter.

Attention is drawn to U.S. Pat. Nos. 1,238,557, 1,348,841, 2,385,823, 2,562,425, 2,813,938, 3,011,039, 3,086,092, 3,121,151, 3,670,284, 3,771,387 and 3,807,254.

SUMMARY OF THE INVENTION

An object of this invention is to provide a range limiter for a thermostat which is readily changeable, but is not readily accessible to unauthorized persons. Another object is to provide such a range limiter which is readily attachable to a thermostat without involving any physical modification of the thermostat. Other objects and advantages of this invention are set out herein or are obvious to one ordinarily skilled in the art herefrom.

This invention is used in a standard thermostat which usually comprises a base structure; an ambient temperature responsive element mounted on the base structure; a switch mechanically connected to the temperature responsive element such that the switch is caused to open and close by the temperature responsive element above and below a predetermined temperature; and means for controlling the relationship between the swtich and the temperature responsive element to vary the predetermined temperature. A cover is usually provided over the elements and is removably attached to the base.

The means for controlling the relationship between the switch and the temperature responsive element typically includes a manually operable temperature setting member which protrudes through the cover to enable the operator to set the temperature at which the switch will actuate the heating or cooling apparatus.

A range limiter is mounted within the thermostat so as to limit the movement of the manually operable thermostat setting member. The range limiter is readily replaceable after said cover is taken off to facilitate the imposition of different ranges on the thermostat user. The invention consists of a template which is removably attached within the thermostat so as to physically limit the extent of travel of the thermostat setting member, thereby limiting the range of operation of the thermostat.

There is a need to limit the temperature range over which an occupant can vary the temperature in a rented, leased, etc., building, room, etc. This invention provides a ready means for setting desired upper and lower temperature limits, which can easily be changed by the owner and not by the occupant. This invention allows a savings of heat in the winter and a savings of cooling in the summer, without depriving the occupant of the option of varying the room temperature within the normal temperature comfort zone.

The range limiter is to be used with a thermostat wherein the manually operable thermostat setting member is an elongated member, pivotally mounted on the end opposite from the end which extends through the cover. The range limiter is generally a flat plate having a notch therein. The sides of the notch limit the range of movement of the thermostat setting member.

BRIEF DESCRIPTION OF THE DRAWINGS

FIG. 1 is an exploded perspective view showing a thermostat with a range limiter according to this invention.

FIG. 2 is a perspective view of the range limiter of FIG. 1.

FIG. 3 is a top view of an alternative embodiment of a range limiter according to this invention.

FIG. 4 is a partial exploded perspective view showing the range limiter of FIG. 3.

DETAILED DESCRIPTION OF THE PREFERRED EMBODIMENTS

One of the preferred embodiments of a range limiter according to this invention is indicated generally by 10 in FIG. 1. This range limiter 10 is shown associated with a standard thermostat assembly, specifically Minneapolis Honeywell Model No. T651A. This thermostat generally comprises a base 12; ambient temperature responsive elements 14 (typically bi-metallic springs which move due to temperature changes); switch 16 which is opened or closed by movement of the ambient temperature responsive elements 14; and means for varying the predetermined temperature at which the switch 16 opens or closes, indicated generally at 18. Means 18 includes manually operable temperature setting member 20 pivotally attached to base 12 and temperature indicating plate 22. The occupant manually adjusts the pointed portion of member 20 to the desired temperature indicated on temperature indicating plate 22. The ambient temperature sensing elements 14 and switch 16 control the operation of the heating or cooling system to maintain the preset temperature in known fashion.

Cover 24 fits over the above desribed elements of the thermostat and is removably attached to base 12 by screws, clips or the like (not shown). Slot 26 through the top of cover 24 allows the temperature indicating plate 22 and manually operable temperature setting member 20 to protrude therethrough so as to facilitate manual manipulation when the cover is installed. Cover 24 may include ambient temperature indicating means 28 if desired, although it is not mandatory. It is understood that the apparatus heretofore described constitutes a standard thermostat and forms no part of this invention. The thermostat has been described only in general terms since anyone possessing reasonable skill in the art would know the structural and functional details of such known apparatus.

As stated previously, the temperature setting member 20 is moved about its pivot in a generally lateral direction, indicated by arrow 30, to set the desired temperature. The range limiter 10 effectively limits the amount of movement of the temperature setting member 20, thereby limiting the temperatures at which the thermostat may be set. The range limiter 10, shown in FIG. 2, has a generally flat body portion 32 and flanges 34 and 36 which serve to define notch 38. Flanges 34 and 36 extend generally perpendicularly from flat body portion 32, and are in a common plane.

The base 12 of the thermostat shown in FIG. 1 has protrusions 40 and 42 which extend through openings 44 and 46, respectively, in temperature indicating plate 22 and are connected to one end of each of the ambient temperature sensing elements 14. The range limiter 10 has indented portions 48 and 50 on the lower portion of each side. The lateral width between the indented portions, dimension A in FIG. 2, is slightly less than the lateral dimension between the protrusions 40 and 42 to enable the lower portion of the range limiter 10 to fit therebetween. The vertical dimension of each notch, shown as dimension B in FIG. 2, is slightly larger than the vertical dimension of the protrusions 40 and 42. The range limiter also has tabs 52 and 54 which are generally parallel to each other and perpendicular to the flat portion 32.

In operation, the range limiter is installed in the thermostat as shown in FIG. 1, such that the horizontal upper edges of indented portions 48 and 50 rest against the upper edge of protrusions 40 and 42 while temperature setting member 20 protrudes through notch 38. Flanges 34 and 36 extend toward the cover 24. After the range limiter has been placed in this position, tabs 52 and 54 are manually deformed so as to be coplanar with flat body portion 32 and engage the lower edge of protrusions 40 and 42, thereby fixing the limiter in position. The lateral edges of flanges 34 and 36 defining the notch 38 bear against the temperature setting member 20 in the extreme position to thereby limit the range of temperatures to which the thermostat may be adjusted.

An alternative embodiment of the temperature range limiter is shown in FIGS. 3 and 4. This embodiment is intended for use in those thermostats which have the temperature setting member protruding from the bottom or side of the cover, such as the White-Rodgers model No. 1E30-919. This thermostat operates on the same principles as previously discussed i.e., a switch is controlled by an ambient temperature sensing member to turn on or turn off the heating or cooling system. A manually adjustable temperature setting member extends from a removable cover over the mechanism to enable the operator to set the desired temperature to be maintained by the thermostat. In this particular thermostat model, all components are attached to a base and the cover is removably attached to the base. Depending upon the orientation of the base, the temperature setting member extends from either side or the bottom of the thermostat.

This embodiment of the range limiter 10' is shown in FIG. 3 and comprises a generally flat body portion 56 having coplanar flanges 58 and 60 which define notch 62. The lateral dimension of the range limiter, shown as dimension C in FIG. 3, is slightly less than the interior width of the cover such that the range limiter can fit inside the cover, as shown in FIG. 4. FIG. 4 shows a rear view of the cover 64 removed from the base (not shown). Cover 64 has ridges 66 and 68 adjacent the bottom, and the range limiter 10' is placed between the ridges and the bottom and is thereby retained in position.

When the cover is replaced on the base, the temperature setting member extends through the notch 62. The sides of the notch physically limit the range of temperatures to which the thermostat may be adjusted.

While the invention has been described in its preferred form, it is not limited to the exact structures illustrated, and various changes and modifications may be made without departing from the scope of the appended claims.

I claim:

1. In a thermostat having a base; a switch electrically connected to a control circuit of a heating and/or cooling system such that opening and closing of the switch controls the actuation of the heating and/or cooling system; ambient temperature responsive means attached to the base and connected to the switch such that movement of the ambient temperature responsive means caused by changes in ambient temperature opens and closes the switch; means for varying the temperature at which the ambient temperature responsive means causes the switch to open or close, said means including a manually operable temperature setting member pivotally attached to the base; and a cover removably attached to the base, the improvement comprising a range limiter comprising:

(a) a generally flat body portion having a generally rectangular shape;

(b) at least two flanges extending from one edge of said flat body portion, said flange being spaced laterally apart so as to define a notch therebetween; and (c) means to attach said flat body portion to said thermostat such that the range limiter is within said cover and said temperature setting member protrudes through said notch.

2. The thermostat range limiter of claim 1 wherein said flanges are coplanar and extend generally perpendicularly from said flat body portion.

3. The thermostat range limiter of claim 2 wherein said means to attach said flat body attaches said flat body to the base of the thermostat.

4. The thermostat range limiter of claim 1 wherein said flanges are coplanar with the generally flat body portion.

5. The thermostat range limiter of claim 4 wherein said means to attach said flat body attaches said flat body to the cover of the thermostat.

6. The thermostat range limiter of claim 2 wherein said flat body portion has an indentation on each lateral edge thereof.

7. The thermostat range limiter of claim 6 further comprising a pair of generally parallel tabs extending perpendicularly from the lowermost lateral corners of the flat body portion, said tabs being deformable to attach the range limiter to the thermostat.

* * * * *